United States Patent [19]

Weiss

[11] Patent Number: 4,749,593

[45] Date of Patent: Jun. 7, 1988

[54] COATING ARRANGEMENT AND PROCESS FOR PREVENTING DEPOSITS OF A COATING MATERIAL

[75] Inventor: Hardy P. Weiss, Hütten, Switzerland

[73] Assignee: Prazisions-Werkzeuge AG, Ruti, Switzerland

[21] Appl. No.: 831,512

[22] Filed: Feb. 21, 1986

[30] Foreign Application Priority Data

Feb. 21, 1985 [CH] Switzerland ..... 834/85

[51] Int. Cl.[4] ..... B05D 1/12; B05D 1/02; B05B 12/02

[52] U.S. Cl. ..... 427/180; 427/185; 427/421; 118/302; 118/312; 118/326; 118/DIG. 7

[58] Field of Search ..... 427/185, 180, 421; 118/302, 326, 312, DIG. 7

[56] References Cited

U.S. PATENT DOCUMENTS

| | | | |
|---|---|---|---|
| 1,788,600 | 1/1931 | Smyser . | |
| 1,830,598 | 11/1931 | Fagan . | |
| 1,839,731 | 1/1932 | Baum . | |
| 2,279,361 | 4/1942 | Amstuz | 91/68 |
| 2,672,842 | 3/1954 | Winters et al. | 118/2 |
| 2,753,796 | 7/1956 | Wood et al. | 101/147 |
| 2,773,472 | 12/1956 | Lamm | 118/51 |
| 2,884,895 | 5/1959 | Lopenski et al. | 118/302 |
| 2,974,060 | 3/1961 | Dettling . | |
| 2,996,040 | 8/1961 | Bofinger | 118/301 |
| 3,016,875 | 1/1962 | Ballentine, Jr. et al. | 118/306 |
| 3,077,171 | 2/1963 | Gatsch et al. | 113/120 |
| 3,161,530 | 12/1964 | Strobel . | |
| 3,208,868 | 9/1965 | Strobel et al. . | |
| 3,248,253 | 4/1966 | Barford et al. . | |
| 3,291,631 | 12/1966 | Smith . | |
| 3,295,440 | 1/1967 | Rarey et al. | 101/114 |
| 3,296,999 | 1/1967 | Gamble | 118/2 |
| 3,327,948 | 6/1967 | Gignoux | 239/2 |
| 3,336,903 | 8/1967 | Paint | 118/624 |
| 3,358,639 | 12/1967 | Lopenski et al. | 118/49.5 |
| 3,377,183 | 4/1968 | Hurt, Jr. et al. . | |

(List continued on next page.)

FOREIGN PATENT DOCUMENTS

| | | |
|---|---|---|
| 0054757 | 6/1982 | European Pat. Off. . |
| 0093083 | 11/1983 | European Pat. Off. . |
| 0120810 | 10/1984 | European Pat. Off. . |
| 0152375 | 8/1985 | European Pat. Off. . |
| 2058350 | 5/1972 | Fed. Rep. of Germany . |
| 2933641 | 4/1980 | Fed. Rep. of Germany . |
| 2914960 | 10/1980 | Fed. Rep. of Germany . |
| 3144467 | 8/1982 | Fed. Rep. of Germany . |
| 3127881 | 11/1982 | Fed. Rep. of Germany . |
| 3117713 | 7/1983 | Fed. Rep. of Germany . |
| 3117715 | 7/1985 | Fed. Rep. of Germany . |
| 2724060 | 1/1986 | Fed. Rep. of Germany . |
| 2097761 | 3/1972 | France . |
| 603249 | 8/1978 | Switzerland . |
| 648496 | 3/1985 | Switzerland . |
| 2003754 | 3/1979 | United Kingdom . |
| 2028171 | 3/1980 | United Kingdom . |

*Primary Examiner*—Janyce A. Bell
*Attorney, Agent, or Firm*—Antonelli, Terry & Wands

[57] ABSTRACT

To prevent a formation of aerodynamic dead zones in a coating arrangement for powder coating, such as, for example, weld seams, a surface of a supporting member is provided with a constantly increasing radius of curvature between an outlet orifice for a spray jet and an exhaust orifice, starting with the former. A feed conduit is fashioned so that a laminar flow of the coating medium does not experience a change in an arithmetic sign of its path of curvature in the orifice zone and along a subsequent surface. For a constant acceleration of the spray jet, a constant reduction of the flow cross section is provided for the spraying medium between the outlet and the exhaust conduit.

20 Claims, 1 Drawing Sheet

U.S. PATENT DOCUMENTS

| | | | |
|---|---|---|---|
| 3,377,184 | 4/1968 | Kukoff . | |
| 3,394,450 | 7/1968 | Gill et al. | 29/430 |
| 3,422,795 | 1/1964 | Smith | 118/308 |
| 3,491,721 | 1/1970 | Gill et al. | 118/622 |
| 3,501,062 | 3/1970 | DeWitt et al. | 222/161 |
| 3,526,027 | 9/1970 | Manuel et al. | 29/200 |
| 3,570,716 | 3/1971 | Kirsanoff et al. | 222/67 |
| 3,575,138 | 4/1971 | Austin et al. | 118/634 |
| 3,585,060 | 6/1971 | Gourdine et al. . | |
| 3,654,898 | 4/1972 | Galitz | 118/323 |
| 3,675,617 | 7/1972 | Winkless | 118/326 |
| 3,678,336 | 7/1972 | Winkless | 317/3 |
| 3,713,862 | 7/1972 | Winkless . | |
| 3,745,034 | 7/1973 | Smith et al. . | |
| 3,840,138 | 10/1974 | Mohr | 219/10.57 |
| 3,868,925 | 3/1975 | Smith et al. | 118/621 |
| 3,882,818 | 5/1975 | Mowbray | 118/312 |
| 3,888,207 | 6/1975 | Stutz et al. | 118/621 |
| 3,897,908 | 5/1975 | Galitz | 239/586 |
| 3,918,401 | 11/1975 | Blakeslee | 118/630 |
| 3,976,031 | 8/1976 | Itah | 118/629 |
| 3,995,075 | 11/1976 | Cernauskas et al. | 427/236 |
| 4,002,143 | 1/1977 | Dover | 118/326 |
| 4,027,607 | 6/1977 | Pan et al. | 118/2 |
| 4,060,647 | 11/1977 | Pan et al. | 427/21 |
| 4,072,127 | 2/1978 | Cernauskas et al. | 118/2 |
| 4,098,226 | 7/1978 | Furter | 118/622 |
| 4,138,161 | 2/1974 | Payne | 302/28 |
| 4,158,071 | 6/1974 | Jordan et al. | 427/33 |
| 4,165,134 | 8/1979 | Payne . | |
| 4,171,096 | 10/1979 | Welsh et al. | 239/291 |
| 4,205,621 | 6/1980 | Payne et al. | 118/622 |
| 4,212,266 | 7/1980 | Payne et al. | 118/7.2 |
| 4,215,648 | 8/1980 | Stamets et al. | 118/622 |
| 4,218,493 | 8/1980 | Rarey | 427/27 |
| 4,230,068 | 10/1980 | Itoh et al. | 118/326 |
| 4,233,335 | 11/1980 | Etlin | 427/27 |
| 4,245,551 | 1/1981 | Berkmann | 98/115 SB |
| 4,259,923 | 4/1981 | Brien | 118/622 |
| 4,346,667 | 8/1982 | Stamets et al. | 118/622 |
| 4,375,487 | 3/1983 | Huber | 118/326 |
| 4,389,234 | 6/1983 | Lindner | 118/326 |
| 4,401,445 | 8/1983 | Browning | 118/326 |
| 4,588,605 | 5/1986 | Frei et al. | 427/28 |

$3_o$
$3_u$
13
$7_u$
25
21
$N_{13}$
5
$Q_b$
19
$Q_a$
$N_{11}$
15
$N_9$
S
23
$7_o$
$Q_9$
9
B
$A_{11}$
$R_1$
$R_2$
$Q_{11}$
11
1
3
A
$Q_{13}$
$Q_c$
13
$Q_d$ 9
23
15
11
3
17
$7_i$
21
$Q_c$
13
$Q_d$
S
A
$7_o$
$M'_9$
5
19
$7_u$

19
$R_b$
$N_{11}$
$Q_{11}$
3
11b
11a
5
15
$R_1$
$R_2$
$R_a$
$Q_9$
$N_9$
III
23
$7_o$
9
11
$A_{11}$
III

3
E
$M_9$
$K_9$

COATING ARRANGEMENT AND PROCESS FOR PREVENTING DEPOSITS OF A COATING MATERIAL

The present invention relates to a coating arrangement and a process of preventing a deposition of coating material on a coating head of the coating arrangement.

Coating arrangements with a supporting member have been proposed wherein at least one feed conduit terminates at the surface of the latter, for spraying a jet of gaseous carrier medium in liquid or solid coating particles, with at least one exhaust conduit for the carrier medium and coating particles having an inlet orifice at the surface of the member, wherein normals to the cross-sectional surfaces of the conduits lie, in their inlet and outlet zones, respectively, at least in one plane.

Additional coating arrangements have been provided which include a supporting member having at least one fed conduit, terminating at the surface of the latter, for a spray jet of gaseous carrier medium and liquid or solid coating materials, wherein a recess is formed in the surface following the outlet orifice, and with a longitudinal axis of the recess lying in one plane of a central axis of the feed conduit in the orifice zone for the formation of a coating chamber, together with a component to be coated guided thereabove.

Additionally, a process has been proposed for the prevention of deposits of coating material on the coating head which is provided with a feed conduit having an outlet orifice for a spray jet of gaseous carrier medium and liquid or solid coating particles, and at least one exhaust conduit with an inlet orifice for taking in by suction the excess coating material, and with a surface of the component to be coating being guided over the orifices, as well as a coating arrangement with a supporting member, having at least one feed conduit, terminating at the surface of the latter, for a spray jet of gaseous carrier medium in liquid or solid coating particles, which supporting member has at least one exhaust conduit, terminating from the surface of the member, for the carrier medium and coating particles, wherein the normals to the cross-sectional surfaces of the conduits lie in their orifice zones at least almost in one plane.

The coating arrangements and processes of the aforementioned type are utilized, for example, in powder coating of metal can bodies, especially weld seams thereof, in continuous processes wherein the can bodies are moved continuously along and over a supporting member of the arrangement. The coating arrangements include, in addition to a feed conduit for the spray jet, at least one, and usually two exhaust conduits, with one conduit lying upstream, and the other conduit lying downstream with respect to the direction of movement of the bodies to be coated and with respect to the termination of the feed conduit.

One problem arising in the above-type coating installation resides in the fact that so called aerodynamic dead zones are formed between the termination of the feed conduit and the beginning of the exhaust conduits. In the dead zones, coating particles are deposited on the supporting member surface of the arrangement and increasing the change the aerodynamic profile thereof.

The aim underlying the present invention essentially resides in providing a coating arrangement and process which avoids the above noted problems and disadvantages encountered in the prior art.

In accordance with advantageous features of the present invention, a coating arrangement is provided wherein a supporting member is provided with at least one conduit terminating at a surface of the member for the spraying of a jet of gaseous carrier medium and liquid or solid coating particles, as well as at least one exhaust conduit with an entrance at the surface of the member for the carrier medium and coating particles. Respective and normals of the cross sectional areas of the conduits, in the inlet and outlet zones, lie at least almost in one plane. A sectional curve region of a member surface, formed by the one plane exhibits a constantly increasing radius of curvature between the conduit orifices starting with the orifice of the feed conduit.

In a construction wherein two exhaust conduits are provided, one of which terminates, with respect to the travel direction of the components to be coated, directly upstream of the termination of the feed conduit, the coating arrangement of the present invention is provided with the exhaust conduit located upstream.

By virtue of the features of the present invention, it is possible to provide optimum relationships by constructing the coating arrangement such that the sectional curve region is at least in sections and at least approximately along a logrithmetic spiral.

To prevent the cutting of the spray jet flow in a zone of the exhaust conduits, according to further features of the present invention, the normal of the cross-sectional area of the exhaust conduit inlet zone is at an obtuse angle with respect to that of the cross-sectional area of the feed conduit outlet zone, and a sectional curve of the exhaust conduit inlet zone, lying in opposition to the sectional curve region is of a constant curvature without any lip-like edges.

In accordance with further advantageous features of the present invention, a cross-sectional area of the exhaust conduit inlet zone has an oval-shape and is fashioned so as to be somewhat elliptical or is bordered by pieces of a straight line passing over on both sides into semicircular arcs, wherein the longitudinal axis of the oval or elliptical shape lies at least almost perpendicularly to the plane.

By virtue of the above noted features, it is possible provide a coating arrangement which, while retaining a relatively small height of the termination of the exhaust conduit in the above noted plane, a broad exhaust action is possible perpendicularly to the plane and correspondingly over a wide coating zone.

The exhaust conduit may, in accordance with the present invention, be constructed such that it passes over, in a longitudinal direction thereof, from an oval or elliptical cross-sectional configuration constantly into a circular cross-sectional configuration while, preferably, constantly decreasing in cross-sectional area thereby resulting in a constantly accelerated exhausted spray jet.

It is also possible in accordance with the present invention to provide a coating arrangement of the above described type wherein the supporting member is provided with at least one feed conduit terminating at a surface of the latter, for a spray jet of gaseous carrier medium and a liquid or solid coating particles, with a recess being formed in the surface following the outlet of the orifice. A longitudinal axis of the recess lies in one plane with a central axis of the feed conduit in the zone of the orifice for formation of a coating chamber, together with a component to be coated being guided thereover. The feed conduit, starting with a zone that is set back substantially farther from the outlet than given by the dimension of the diameter of the cross sectional area in the outlet zone, as well as the base of the recess, form, in the above noted plane, a section curve which has a curvature without a change in arithmetic sign.

It has been determined that, upon the occurrence of a change in arithmetic sign of the laminar flow curvature along the recess forming the coating chamber and along an adjoining zone of the feed conduit amounting to a multiple value of its diameter in its orifice region, an uncontrolled turbulence will be created in the feed conduit outlet zone which sometimes gives rise to deposits of the coating material.

In order to avoid if not at least partially eliminate the above noted deposition of the coating materials, it is possible, in accordance with the present invention, to provide a coating arrangement wherein the feed conduit is extended in a zone thereof at least substantially along a straight line thereby providing additional advantages from the viewpoint of manufacturing techniques.

Additionally, the present invention proposes a process for preventing a depositing of coating material on a coating head with a feed conduit and with an outlet orifice for a spray jet of gaseous carrier medium in liquid or solid coating particles, and at least one exhaust conduit with an inlet orifice for taking in, by suction, the excess coating material. A surface or surfaces of the component to be coated are guided above and along the orifices. A stream of gas propelled coating material, after exiting the outlet orifice, is constantly accelerated at least along a section at least partially upstream of the inlet orifice of the exhaust conduit.

By virtue of the above noted features of the process of the present invention, the stream of gas-propelled coating particles is constantly accelerated after exiting from the orifice of the feed conduit, at least along the above noted section, so that the tendency toward deposits of the coating material and/or encrustations in this section of the coating head surface is considerably reduced.

In accordance with another coating arrangement of the present invention for performing the above noted process, a coating arrangement is provided which includes a supporting member, at least one feed conduit, terminating at its surface, for a spray jet of gaseous carrier medium and liquid or solid coating particles, as well as at least one exhaust conduit terminating from the surface of the member, for a carrier medium and coating particles. Normals to the cross-sectional areas of the conduits lie, in their orifice zones, at least almost in one plane. The supporting member with respect to a joining of the orifices, exhibits or includes surfaces located at the top and at the bottom, respectively, which jointly define a junction surface. A surface of the support member lying between the orifices is fashioned as a recess for the formation of a chamber together with a surface of a component to be coated which is guided along above the junction surface. A cross-sectional area of the recess, concommitantly defined by the junction surface, decreases constantly after the outlet orifice of the feed conduit and in front of the inlet orifice of the exhaust conduit, in certain cases also downstream thereof at least along a section thereof.

In order to eliminate the need for providing additional structural measures in the recess, according to the present invention, a reduction in cross sectional area may be realized by a reduction in an area contour of the recess cross section.

The principle of a constant flow acceleration is, in the coating arrangement of the present invention, advantageously obtained, preferably, in a section of the exhaust condjuit joining the entering orifice. In this connection, the outlet orifice of the feed conduit exhibits a cross sectional area normal which is steeper, with respect to the junction surface, than a cross sectional area normal of the inlet orifice of the exhaust conduit. The inlet orifice of the exhaust conduit is formed by a slot-like aperture having a large axis transversely to the above noted plane, and the cross-sectional area of the cross conduit constricts constantly into a cross-sectional area of a circle along a section of the exhaust conduit with a reduction. This may also be effected by a constant narrowing of the cross-sectional area of the exhaust conduit.

In order to realize the above construction in a structurally simple manner, advantageously, in accordance with still further features of the present invention, the supporting member is made or fashioned, in at least in a zone of the exhaust conduit of two parts, wherein adjoining surfaces intersect the exhaust conduit at least in a zone of a reducing cross section and, preferably, along lines defining the outside of the conduit thereby making it possible to respectively incorporate the constantly narrowing halves of the exhaust conduit into one surface of the two parts and inherently seal the exhaust conduit by a super imposition of the parts.

Preferably, in accordance with further features of the present invention, the exhaust conduit lies directly in a zone of the feed conduit, with a second exhaust conduit, farther remote therefrom, being optionally provided with a feed conduit such as described hereinabove.

As can readily be appreciated, in accordance with the present invention, all of the above individual cited features of the coating arrangement may be utilized in combination with each other.

These and other obejcts, features, and advantages of the present invention will become more apparent from the following description when taken in connection with the accompanying drawings which show, for the purposes of illustration only, several embodiments in accordance with the present invention.

Figure 1:
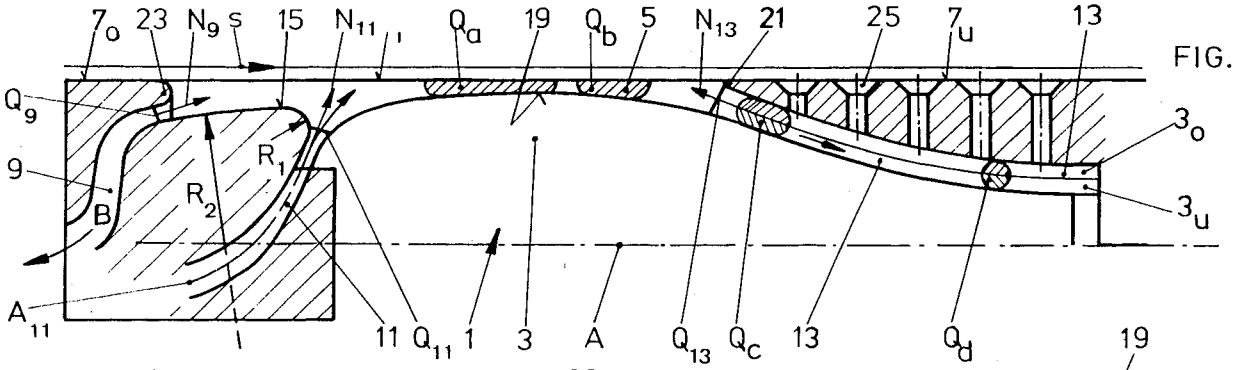
FIG. 1 is a longitudinal cross sectional view of one embodiment of a coating head constructed in accordance with the present invention.

DETAILED DESCRIPTION:

Referring now to the drawings wherein like reference numerals are used throughout the various views to designate like parts and, more particularly, to FIG. 1, according to this figure, a coating head generally designated by the reference numeral 1 comprises a supporting member 3 which extends or is elongated along an axis A and includes, on a surface thereof, a channel-like formed recess 5. Surfaces of components to be coated are guided through or along a travel path in a direction of the arrow s above the channel and/or recess 5 and are guided with respect thereto upstream and downstream over surfaces $7_o$ and $7_u$, respectively, by, for example, brushes (not shown). The channel-like formed recess 5 longitudinally extends in the direction of the axis A and is symmetrical with respect thereto. The surfaces $7_o$, $7_u$ define a junction surface $7_i$ above the channel 5. Directly at the beginning of the channel-like formed recess 5, as viewed in the direction s, an exhaust conduit 9 terminates into an end face of the channel 5. Downstream, as viewed in the direction s, a feed conduit 11 terminates in the channel-like formed recess 5 which latter, at its end, finally ends in a further exhaust conduit 13. Cross sectional areas $Q_9$, $Q_{11}$, and $Q^1{}_3$, respectively, of the conduits 9, 11, 13, respectively, have or exhibit surface normals $N_9$, $N_{11}$, and $N_{13}$, respectively, which lie in a common plane E (FIG. 4) representing the section plane of FIG. 1.

Starting with the relationship between the feed conduit 11 and the exhaust conduit 9, it can readily be seen that the section curve of the plane E with the surface 15 of the supporting member 13 connecting the orifices of the conduit 9, 11 is constructed so that its radius of curvature R constantly increases, beginning with the orifice zone of the conduit 11 toward the orifice zone of the conduit 9, in correspondence with the transition of $R_1$-$R_2$ according to FIG. 1. Only after the orifice zone of the conduit 9, and without the influence of the aerodynamic relationships in the channel-like formed recess 5, and/or the coating chamber formed by the channel-like recess 5 and a component to be guided thereover, does the radii define the section curve and/or the surface 15 arrive at a fixed value. As for the flow in the zone B, downstream of the orifice conduit 9, the conduit 9 can be extended somewhat arbitrarily within broad limits depending upon the particular use of the coating arrangement. Preferably, the curve 15 follows a lagarithmic spiral, at least in a section between the orifices.

A section 19, associated with the plane E, formed by the surface normals, with the member 3 between the feed conduit 11 and the exhaust conduit 13 is curved as shown in FIG. 1 in a wing-shaped profile with a larger radius of curvature toward the inlet orifice of the conduit 11.

Figure 3:
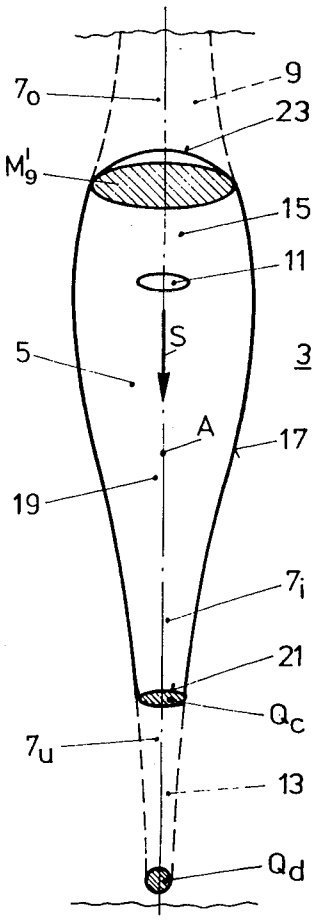
FIG. 3 is a schematic top view of a coating chamber channel of a coating head of FIG. 1.

As shown in FIG. 3, and from the cross sectional areas $Q_a$, $Q_b$, $Q_c$, $Q_d$ in FIG. 1, the lateral channel walls 17 converge with increasing distance from the orifice of the conduit 11. Consequently, the cross-sectional area of the channel-like formed recess 5, sealed at the top by the component to be coated, continuously decreases in the direction of the arrow s. The wing-shaped profile like basic contour 19, starting with the outlet of the feed conduit 11 to the inlet of the exhaust conduit 13, is continued in the section of the exhaust conduit 13 again leading back to the support member 3. The surface normal $N_{13}$ is, with respect to the direction s, in a substantially more obtuse angle than the surface normal $N_{11}$ of the feed conduit 11 which lies at an acute angle with respect to the direction s. The former yields, facing the direction s, a lip-like termination of the channel-like recess 5, with the lip 21 of the exhaust conduit inlet. The lip 21 and a lip 23, formed by virtue of the acute angled orientation of the surface normal $N_9$, with respect to the direction s, are curved continuously without formation of sharp lips or edges projecting into the intake streams similar to, for example, a whistle. Exhaust bores 25 project from the exhaust conduit 13 into the surface $7_u$ in order to additionally take in, by suction, any coating material not sufficiently adhering to the surface to be coated. As shown in FIG. 3, the exhaust conduit 13 passes over from the oval cross section $Q_c$ with a constant reduction in the cross sectional area of the conduit, into a circular cross section $Q_d$. In FIGS. 1 and 3, the shaded areas $Q_a$–$Q_d$ are folded into the respective planes of the figures.

Figure 4:
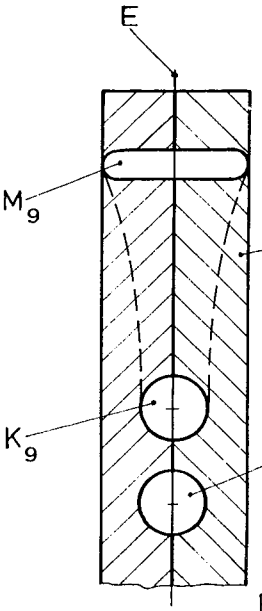
FIG. 4 is a cross-sectional view taken along the line III—III in FIG. 2.

As shown in either FIGS. 3 or 4, the orifice of the exhaust conduit 9, $M'_9$ and $M_9$, respectively, is also of an oval configuration and, respectivley, an elliptical shape. The conduit cross section of the conduit 9 then passes over in a constant fashion into a circular cross section $K_9$. In order to facilitate a manufacture of a relatively complicated conduit route, at least this portion of the support member or coating head 3 is bipartite as shown most clearly in FIG. 4 so that one half of the respective conduits can be incorporated into one of the parts, with the conduits being sealed by super imposition of the two parts.

Figure 2:
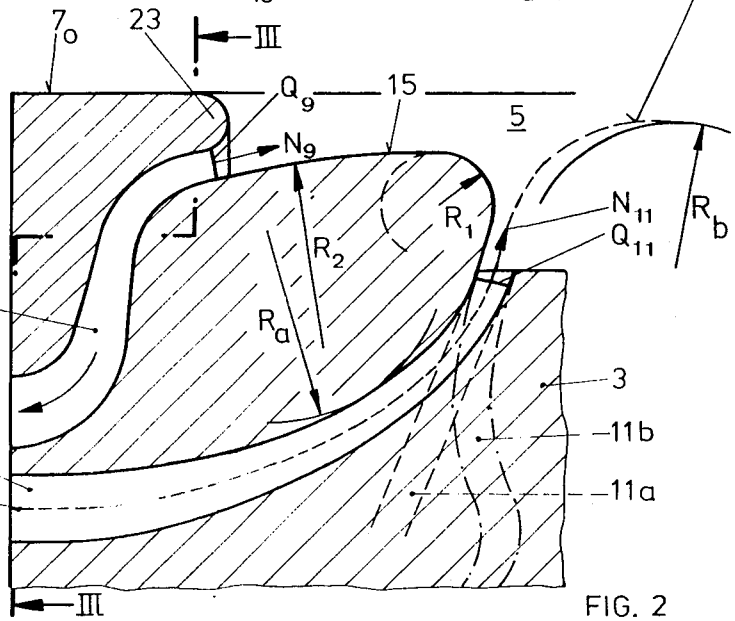
FIG. 2 is a cross-sectional detail view, on an enlarged scale, of a portion of an end face of the coating head of FIG. 1.

As shown most clearly in FIG. 2, the flow passes through the feed conduit 11 with a center line $A_{11}$ and, in an extension, along the airfoil profile 19, that is, a laminar flow, following a route along which the curvatures change an arithmetic sign in correspondence with $R_a$ and $R_b$, respectively. It has been determined that such a route is extraordinarily disadvantageous especially in a zone of the outlet of the conduit 11. This is so because, due to the centrifugal forces, with an arithmetic sign reversal of the laminar flow curvature, a reversal of the arithmetic sign of the direction of turbulences in the cross-sectional area of the spray jet is, perforce, brought about, with an uncontrollable turbulence when the turbulence direction passes through zero. For this reason, in a deviation from the extension of the conduit 11 illustrated in the solid lines in FIGS. 1 and 2, the conduit, as shown in phantom lines in FIG. 2, is preferably constructed in a section before its termination into the channel-like recesses 5 so that the spray jet route laminar flow, continued into the channel-like recess 5, in the above noted sense, does not experience a reversal in arithmetic sign of its curvature.

As shown in FIG. 2, the conduit 11 is extended at least in a straight line, or even, as indicated in the phantom lines, with a curvature corresponding to a continuation along the wing-shaped profile 19, in a section of the conduit 11 upstream of the termination thereof, which section is substantially longer than its cross sectional diameter. The linear extension of the conduit is denoted by the reference numeral 11a, with the section curved like the airfoil profile being designated by the reference numeral 11b.

As apparent from the above description, the measures of features proposed by the present invention may be separately or independently used. More particularly, the present invention proposes increasing a radius of curvature R between the orifices of the conduits 11, 9, reducing a cross-sectional area of the channel-like recess 5, reducing cross-sectional areas of a conduit with respect to conduits 13, 9 and configuring the conduit 11 upstream of its orifice. Again, applicant notes that each of these individual features can be provided optionally independently of one another and, in certain cases, even singly so as to result in significantly improved coating arrangement.

The problem of continuous cross-sectional reduction of the exhaust conduit 13 of FIGS. 1 or 3 may additionally be constructionally solved in a simple manner by fashioning the supporting member or coating head 3, as illustrated in FIG. 1, as two partial members $3_o$ and $3_u$, each of which respectively form a half of the converging exhaust conduit 13, with the partial members $3_o$, $3_u$ being superimposed and joined by a fastener means such as, for example, screws. By this construction, the structural problem of incorporating a curved construction, the structural problem of incorporating a curved converging conduit into a solid component is solved in an extremely simple manner. The bipartite characteristics of the member 3 is also indicated by the bipartite shading of the cross-sectional area $Q_c$, $Q_d$ in FIG. 1.

While I have shown and described several embodiments in accordance with the present invention, it is understood that the same is not limited thereto but susceptible to numerous changes and modifications as known to one having ordinary skill in the art, and I therefore do not wish to be limited to the details shown and described herein, but intend to cover all such modifications as are encompassed by the scope of the appended claims.

I claim:

1. A coating arrangement comprising a supporting member, at least one feed conduit means terminating in an orifice at a surface of the supporting member for enabling a spray jet of gaseous carrier medium and at least one of a liquid and solid coating particles, at least one exhaust conduit means having an orifice in the surface of the supporting member for exhausting an excess of at least one of the carrier medium and coating particles, wherein said exhaust conduit means has its orifice upstream of said orifice of said feed conduit means, wherein normals to cross sectional areas of said orifices of said at least one feed conduit means and said at least one exhaust conduit means lie substantially in one plane, and wherein the surface of the supporting member includes a surface area defining when cut by said one plane a steadily curved line extending continuously between said orifice of said feed conduit means and said orifice of said exhaust conduit means.

2. A coating arrangement according to claim 1, wherein said steadily curved line follows, at least in sections, a logarithmic spiral.

3. A coating arrangement according to claim 1, wherein a sectional portion of an inlet area of said at least one exhaust conduit means disposed opposite to said surface area of said supporting member is curved.

4. A coating arrangement according to claim 1, wherein at least one of said orifices of said exhaust conduit means is a slot having a longitudinal axis perpendicular to said plane.

5. A coating arrangement according to claim 4, wherein said slot is one of substantially elliptical and bordered by sections of substantially straight lines linked on both sides by substantially semi-circular arcs.

6. A coating arrangement according to claim 4, wherein said at least one exhaust conduit means which is a slot has a cross sectional area which constantly changes in a longitudinal direction of said exhaust conduit means from a slot-shape to a substantially circular configuration.

7. A coating arrangement according to claim 1, wherein at least one of said exhaust conduit means has a cross sectional area which decreases in a longitudinal direction of said exhaust conduit means from its orifice.

8. A coating arrangement according to claim 1, wherein said at least one feed conduit means and a bottom portion of said supporting member extending downstream of the orifice of said at least one feed conduit means form in said one plane a sectional curve which has a curvature without a change in arithmetic sign, considered from a point in said feed conduit means upstream of said orifice of said feed conduit means by an amount substantially larger than one diameter of said orifice of said feed conduit means.

9. A coating arrangement according to claim 8, wherein said feed conduit means extends substantially straight along said amount upstream said orifice.

10. A coating arrangement according to claim 1, wherein said coating arrangement for coating longitudinal weld seams of tubular bodies on the interior of said bodies.

11. A coating arrangement according to claim 1, wherein said supporting member is part of a mandrel for interior coating of longitudinal weld seams of tubular bodies.

12. a method for coating a work piece comprising the steps of:

injecting a jet of gaseous carrier medium and at least one of liquid and solid particles into a recess within a supporting member, applying said work piece along said recess within said supporting member, propelling at least a part of said coating particles through said recess to coat said work piece; and accelerating at least a part of the jet injected into said recess along a part of said recess by reducing a cross sectional area of said recess within said supporting member.

13. A method according to claim 12 comprising the step of retrieving a part of at least one of said gaseous carrier medium and said coating particles by suction.

14. A method according to claim 12, wherein said jet which is injected is steadily accelerated along said part of said recess by steadily reducing the cross sectional area of said recess.

15. A coating arrangement including a supporting member having a recess formed therein as a coating chamber for coating a surface of a component, at least one feed conduit means terminating within said recess of said supporting member for spraying a jet of gaseous carrier medium and at least one of liquid and solid coating particles, at least one exhaust conduit means terminating within said recess of the supporting member for exhausting at least one of carrier medium and coating particles, at least the cross sectional area of said recess adjacent said exhaust conduit means decreasing in the direction of said exhausting for accelerating at least a part of said jet injected into said recess.

16. A coating arrangement according to claim 15, wherein said exhaust conduit means terminates in a slot-like aperture at said recess of the supporting member, and wherein a cross sectional area of said exhaust conduit means is constricted into a circular cross sectional area along a section of said exhaust conduit means.

17. A coating arrangement according to claim 15, wherein said supporting member at least in one of an area of said exhaust conduit means and an area of said feed conduit means is of a bipartite construction with joining surfaces thereof joining along lines of walls of said conduit means.

18. A coating arrangement according to claim 31, comprising at least one further exhaust conduit means, said further exhaust conduit means terminating upstream of said feed conduit means.

19. A coating arrangement according to claim 15, wherein said surface to be coated is a longitudinal weld seam along the interior of a tubular body.

20. A coating arrangement according to claim 15, wherein said supporting member is a part of a mandrel for interior coating of longitudinal weld seams of tubular bodies.

* * * * *